US010573469B2

(12) United States Patent
Jeong et al.

(10) Patent No.: US 10,573,469 B2
(45) Date of Patent: Feb. 25, 2020

(54) ELECTRICAL CONTACT MATERIAL

(71) Applicants: Hyundai Motor Company, Seoul (KR); Kia Motors Corporation, Seoul (KR)

(72) Inventors: Min Gun Jeong, Seoul (KR); Jeejung Kim, Yongin-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 87 days.

(21) Appl. No.: 15/782,636

(22) Filed: Oct. 12, 2017

(65) Prior Publication Data

US 2018/0174770 A1 Jun. 21, 2018

(30) Foreign Application Priority Data

Dec. 21, 2016 (KR) ..... 10-2016-0175901

(51) Int. Cl.

| | |
|---|---|
| ***H01H 1/023*** | (2006.01) |
| ***H01H 11/04*** | (2006.01) |
| ***C22C 5/06*** | (2006.01) |
| *H01R 13/03* | (2006.01) |
| *H01H 15/18* | (2006.01) |

(52) U.S. Cl.

CPC ..... *H01H 1/023* (2013.01); *C22C 5/06* (2013.01); *H01H 11/04* (2013.01); *H01H 15/18* (2013.01); *H01H 2011/046* (2013.01); *H01R 13/03* (2013.01)

(58) Field of Classification Search

None

See application file for complete search history.

(56) References Cited

U.S. PATENT DOCUMENTS

| | | | | |
|---|---|---|---|---|
| 2,250,135 A * | 7/1941 | Lindemann | H01H 37/20 | 337/333 |
| 2005/0045461 A1* | 3/2005 | Sweetland | H01H 1/06 | 200/275 |
| 2008/0139058 A1* | 6/2008 | Oda | C25D 5/12 | 439/887 |

FOREIGN PATENT DOCUMENTS

| | | |
|---|---|---|
| KR | 10-01521540000 B1 | 6/1998 |
| KR | 10-2016-0069242 A | 6/2006 |
| KR | 10-2016-0062411 A | 6/2016 |
| KR | 10-2016-0063014 A | 6/2016 |

OTHER PUBLICATIONS

Cohen, U., et al, "Development of Silver-Palladium Alloy Plating for Electrical Contact Applications," J. Electrochem. Soc., vol. 131, Nov. 1984, 2489-2495. (Year: 1984).*

* cited by examiner

*Primary Examiner* — William D Young

(74) *Attorney, Agent, or Firm* — Morgan, Lewis, & Bockius LLP

(57) ABSTRACT

An electrical contact material may include a first contact that contacts a negative electrode; a third contact that contacts a positive electrode; and a second contact that is provided between the first contact and the third contact, wherein different plating materials are respectively attached to the first contact, the second contact, and the third contact.

3 Claims, 2 Drawing Sheets

ELECTRICAL CONTACT MATERIAL

CROSS-REFERENCE TO RELATED APPLICATION

The present application claims priority to Korean Patent Application No. 10-2016-0175901 filed on Dec. 21, 2016, the entire contents of which is incorporated herein for all purposes by this reference.

BACKGROUND OF THE INVENTION

Field of the Invention

The present invention relates to an electrical contact material.

Description of Related Art

An opposed switch is formed of a pair of a fixed contact and a moving contact. The fixed contact and the moving contact come into contact with each other by a physical force to open, close, or convert a circuit. Unlike a general switch that has one or two pairs of contacts for normal-open or normal-open/close, a crossing-type switch for two-way electrical conductivity has four pairs of contacts. In this case, for electrical conductivity, a central bridge in a center portion thereof is used and the bridge should maintain a continuously conductive state.

Typically, the switch operates with a structure in which the center portion of the switch is provided as a wall type and thus the switch is placed like a seesaw on the wall. When a contact operates by a physical force, a center portion of the moving contact and an upper end of the wall in the seesaw structure continuously produce friction, and accordingly become weak to abrasion. However, unlike the center portion of the seesaw, when a butt contact undergoes contact due to a vertical movement, the contact may be damaged due to an arc. When a typical DC current is used, transition of a metal atom, which is a constituent element of the contact, is generated when the contact undergoes a contact, and thus a protrusion is formed at one contact (i.e., a negative (−) end) and a depression is formed in the opposite contact (i.e., a positive (+) end). When such a protrusion is continuously formed, a problem may occur such as an abnormal contact due to fusion between contacts or locking between the protrusion and the depression, thereby causing a problem in continuous operation of parts or an operation failure.

When no protrusion is formed, fusion between contacts may occur due to heat of an arc or heat from conductivity during relay operation if a silver contact component has an inappropriate content. Such a phenomenon is greatly affected by a material of the switch and a direction of the current. In order to solve the fusion phenomenon, silver is plated on the switch, but silver plating may cause a reliability problem because it has a very low anti-fusion property.

Such a material transition or fusion due to the arc is influenced by a contact component and a contact shape. In order to solve such a problem, a contact material having excellent arc resistivity, such as a silver-oxide alloy, is processed in a rivet form in manufacturing of a relay.

However, since a rivet contact cannot be easily applied to the crossing-type switch, a contact of a silver plating material having a low anti-fusion property has been used. In general, it is difficult to process a silver-oxide contact material having an excellent anti-fusion property in a plating form.

As described above, each contact of the crossing-type switch requires a different characteristic so that it is difficult to assure reliability thereof.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an electrical contact material that is clad as a plating material that is different depending on a location of a corresponding contact.

An electrical contact material according to an exemplary embodiment of the present invention may include a first contact that contacts a negative electrode; a third contact that contacts a positive electrode; and a second contact that is provided between the first contact and the third contact, wherein different plating materials are respectively attached to the first contact, the second contact, and the third contact.

The first contact may be attached with a plating material selected from a group consisting of a AgCu alloy having a Cu content of 20 wt % to 50 wt %, a AgNi alloy having a Ni content of 10 wt % to 30 wt %, and a AgPd alloy having a Pd content of 10 wt % to 70 wt %.

The second contact may be attached with a plating material selected from a group consisting of a AgNi alloy having a Ni content of 10 wt % to 30 wt %, a AgPd alloy having a Pd content of 10 wt % to 40 wt %, a AuCo alloy having a Co content of 1 wt % to 5 wt %, a AuNi alloy having a Ni content of 1 wt % to 10 wt %, and a PdNi alloy having a Ni content of 10 wt % to 30 wt %.

The third contact may be attached with a plating material which is a composite material of silver and an oxide, the oxide is one selected from a group consisting of $AgSnInO_x$, $AgSnO_2$, and AgZnO, and a content of the oxide may be 5 wt % to 20 wt %.

The plating material of the first contact, the plating material of the second contact, and the plating material of the third contact may be attached to a phosphorous-bronze plate.

According to the exemplary embodiment of the present invention, a plating material that is different depending on a location of a contact in the crossing-type switch is attached to the corresponding contact by use of a cladding process so that a contact characteristic that satisfies a requirement for the corresponding location of the contact can be provided, and life-span of the product can be improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
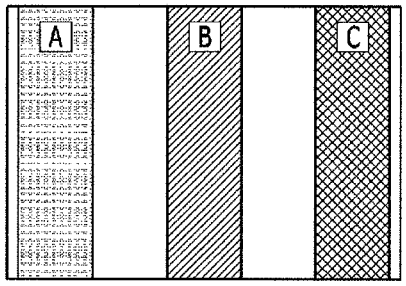
FIG. 1 shows an electrical contact material according to an exemplary embodiment.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present application will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element including a layer, film, region, or substrate is referred to as being "on" another element, it can be directly on the other element or intervening elements may also be present. In contrast, when an element is referred to as being "directly on" another element, there are no intervening elements present.

Hereinafter, an electrical contact material according to an exemplary embodiment of the present invention will be described in detail with reference to the accompanying drawings.

Figure 2:
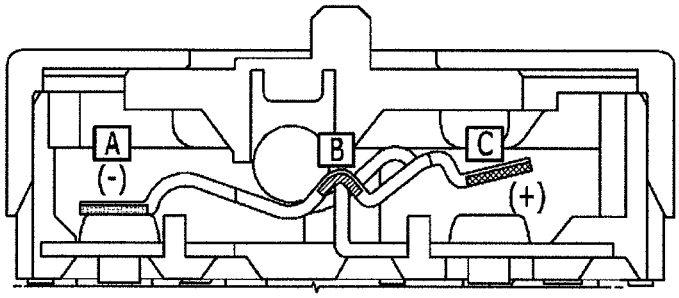
FIG. 2 is a diagram of a crossing-type switch to which the electrical contact material of FIG. 1 is applied.

FIG. 1 shows an electrical contact material according to an exemplary embodiment of the present invention. FIG. 2 is a diagram of a crossing-type switch to which the electrical contact material of FIG. 1 is applied.

Referring to FIG. 1, the electrical contact material according to the present exemplary embodiment includes a first contact A that contacts a negative electrode, a third contact C that contacts a positive electrode, and a second contact B that is provided between the first contact A and the third contact C, and different plating materials are respectively attached to the first contact A, the second contact B, and the third contact C.

Referring to FIG. 1, the plating material of the first contact A, the plating material of the second contact B, and the plating material of the third contact C may be attached to a copper plating material (or plate for switches including phosphor bronze, brass, pure copper). The plating material of the first contact A, the plating material of the second contact B, and the plating material of the third contact C are supplied in a form of tapes onto the phosphorous-bronze plating material, which is provided as a whole plate, and then rolled such that a complex type of plate as in FIG. 1 can be manufactured.

The plating material attached to the first contact A will now be described. The first contact A is a portion that contacts a negative electrode, and needs to maintain low contact resistance. In addition, the first contact A requires high conductivity, high hardness, and corrosion resistance.

Thus, the plating material of the first contact A may be one selected from a group consisting of a AgCu alloy having a Cu content of 20 wt % to 50 wt %, a AgNi alloy having a Ni content of 10 wt % to 30 wt %, and a AgPd alloy having a Pd content of 10 wt % to 70 wt %.

When the plating material of the first contact A is a AgCu alloy, a content of Cu is preferably 20 wt % to 50 wt %. When the Cu content is less than 20 wt %, a sufficient reinforcement effect cannot be acquired, and when the Cu content exceeds 50 wt %, corrosion may occur.

When the plating material of the first contact A is a AgNi alloy, a content of Ni may be 10 wt % to 30 wt %. When the Ni content is less than 10 wt %, a sufficient reinforcement effect cannot be acquired, and when the Ni content exceeds 30 wt %, contact resistance may be significantly increased.

In addition, when the plating material of the first contact A is a AgPd alloy, a content of Pd may be 10 wt % to 70 wt %. When the Pd content is less than 10 wt %, a sufficient reinforcement effect cannot be acquired, and when the Pd contents exceeds 70 wt %, it may be difficult to perform a cladding process.

Next, the plating material attached to the second contact B will be described. The second contact B is a portion that corresponds to the center of a seesaw when being applied to the crossing-type switch, and requires high abrasion resistance and low contact resistance. That is, the second contact B requires high hardness, high abrasion resistance, and high corrosion resistance.

In the instant case, the plating material of the second contact B may be one selected from a group consisting of a AgNi alloy having a Ni content of 10 wt % to 30 wt %, a AgPd alloy having a Pd content of 10 wt % to 40 wt %, a AuCo alloy having a Co content of 1 wt % to 5 wt %, a AuNi alloy having a Ni content of 1 wt % to 10 wt %, and a PdNi alloy having a Ni content of 10 wt % to 30 wt %.

When the plating material of the second contact B is a AgNi alloy, a content of Ni may be 10 wt % to 30 wt %. When the Ni content is less than 10 wt %, a sufficient reinforcement effect cannot be acquired, and when the Ni content exceeds 30 wt %, contact resistance may be significantly increased.

When the plating material of the second contact B is a AgPd alloy, a Pd content may be 10 wt % to 40 wt %. When the Pd content is less than 10 wt % or exceeds 40 wt %, a sufficient reinforcement effect cannot be acquired.

When the plating material of the second contact B is a AuCo alloy, a Co content may be 1 wt % to 5 wt %. When the Co content is less than 1 wt %, a sufficient reinforcement effect cannot be acquired, and when the Co content exceeds 5 wt %, corrosion may occur.

When the plating material of the second contact B is a AuNi alloy, a Ni content may be 1 wt % to 10 wt %. When the Ni content is less than 1 wt %, a sufficient reinforcement effect cannot be acquired, and when the Ni content exceeds 10 wt %, corrosion may occur.

When the plating material of the second contact B is a PdNi alloy, a Ni content may be 10 wt % to 30 wt %. When the content of Ni is less than 10 wt %, a sufficient reinforcement effect cannot be acquired, and when the content of Ni exceeds 30 wt %, contact resistance may be significantly increased.

Next, the plating material attached to the third contact C will be described. The third contact C is a portion that contacts the positive electrode, and the contact is mostly consumed due to a DC current. Thus, the third contact C requires arc-resistivity and an anti-fusion property. The plating material attached to the third contact C may be made of a complex material of silver and an oxide.

The oxide is one selected from a group consisting of $AgSnInO_x$, $AgSnO_2$, and AgZnO, and a content of the oxide may be 5 wt % to 20 wt %. When the content of the oxide is less than 5 wt %, sufficient act-resistivity cannot be acquired, and when the content of the oxide exceeds 20 wt %, electrical conductivity may be deteriorated.

As described above, according to the exemplary embodiment of the present invention, plating materials attached to each contact are different from one another to optimize properties at each contact. Accordingly, different characteristics that are required for the respective contacts of the crossing-type switch can be satisfied while assuring reliability of the switch.

Next, an effect of the electrical contact material according to the exemplary embodiment of the present invention and an effect of an electrical contact material according to a comparative example will be compared through detailed experimental examples.

Experimental Example 1

As shown in FIG. 1, a switch for operation of a seat reclining motor was prepared, and then the switch operated in forward direction-off-reverse direction. A motor rated voltage was 12 V and a current was 10 A.

The following Table 1 shows materials of the first, second and third contacts in comparative examples and exemplary embodiments of the present invention, and a number of durability tests from Experimental Example 1.

TABLE 1

| | First contact A | Second contact B | Third contact C | Number of durability tests |
|---|---|---|---|---|
| Comparative Example 1 | Clad X | Clad X | Clad X | 12,400 |
| Comparative Example 2 | Sliver plating (5 μm) | Sliver plating (5 μm) | Sliver plating (5 μm) | 27,400 |
| Comparative Example 2 | Gold plating (1 μm) | Gold plating (1 μm) | Gold plating (1 μm) | 26,800 |
| Comparative Example 3 | $AgSnInO_x$ rivet, 10 μm | Clad X | $AgSnInO_x$ rivet, 10 μm | 14,800 |
| Comparative Example 4 | $AgSnInO_x$ rivet, 10 μm | Nickel, 3 μm-Silver plating, 1 μm | $AgSnInO_x$ rivet, 10 μm | 28,700 |
| Comparative Example 5 | $AgSnInO_x$ (oxide, 15%) | AgNi20 | AgCu40 | 47,800 |
| Exemplary Embodiment 1 | AgCu40 | AgNi20 | $AgSnInO_x$ (oxide, 15%) | 143,000 |
| Exemplary Embodiment 2 | AgCu40 | PdNi20 | $AgSnInO_x$ (oxide, 15%) | 173,000 |
| Exemplary Embodiment 3 | AgNi20 | AgNi20 | $AgSnInO_x$ (oxide, 15%) | 132,000 |
| Exemplary Embodiment 4 | AgNi20 | PdNi20 | $AgSnInO_x$ (oxide, 15%) | 148,000 |
| Exemplary Embodiment 5 | AgPd30 | PdNi20 | $AgSnInO_x$ (oxide, 15%) | 182,000 |

As shown in Table 1, the number of durability tests was more significantly improved in Exemplary Embodiment 1 to Exemplary Embodiment 5 where different plating materials are respectively attached to the first contact A, the second contact B, and the third contact C than in Comparative Example 1 to Comparative Example 5.

Experimental Example 2

A switch that is the same as that of Experimental Example 1 was prepared, and then a test was performed under the same conditions as in Experimental Example 1 to measure a number of generations of fusion, and Table 2 show results of the test.

TABLE 2

| | First contact A | Second contact B | Third contact C | Number of fusions |
|---|---|---|---|---|
| Comparative Example 1 | Clad X | Clad X | Clad X | 0 |
| Comparative Example 2 | Silver plating (5 μm) | Silver plating (5 μm) | Silver plating (5 μm) | 480 |
| Comparative Example 2 | Gold plating (1 μm) | Gold plating (1 μm) | Gold plating (1 μm) | 11 |
| Comparative Example 3 | $AgSnInO_x$ rivet, 10 μm | Clad X | $AgSnInO_x$ rivet, 10 μm | 17 |
| Comparative Example 4 | $AgSnInO_x$ rivet, 10 μm | Nickel, 3 μm-Silver plating, 1 μm | $AgSnInO_x$ rivet, 10 μm | 12 |
| Comparative Example 5 | $AgSnInO_x$ (oxide, 15%) | AgNi20 | AgCu40 | 182 |
| Exemplary Embodiment 1 | AgCu40 | AgNi20 | $AgSnInO_x$ (oxide, 15%) | 0 |
| Exemplary Embodiment 2 | AgCu40 | PdNi20 | $AgSnInO_x$ (oxide, 15%) | 0 |
| Exemplary Embodiment 3 | AgNi20 | AgNi20 | $AgSnInO_x$ (oxide, 15%) | 2 |
| Exemplary Embodiment 4 | AgNi20 | PdNi20 | $AgSnInO_x$ (oxide, 15%) | 7 |
| Exemplary Embodiment 5 | AgPd30 | PdNi20 | $AgSnInO_x$ (oxide, 15%) | 0 |

As shown in Table 2, a number of fusions was significantly reduced in Exemplary Embodiment 1 to Exemplary Embodiment 5 where different plating materials are respectively attached to the first contact A, the second contact B, and the third contact C than in Comparative Example 1 to Comparative Example 5.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electrical contact material comprising:

a first contact that contacts a negative electrode;

a third contact that contacts a positive electrode; and a second contact that is provided between the first contact and the third contact, wherein different plating materials are respectively attached to the first contact, the second contact, and the third contact, and wherein the first contact is attached with a plating material of an AgCu alloy having a Cu content of 20 wt % to 50 wt %.

2. The electrical contact material of claim 1, wherein the second contact is attached with a plating material selected from a group consisting of a AgNi alloy having a Ni content of 10 wt % to 30 wt %, a AgPd alloy having a Pd content of 10 wt % to 40 wt %, a AuCo alloy having a Co content of 1 wt % to 5 wt %, a AuNi alloy having a Ni content of 1 wt % to 10 wt %, and a PdNi alloy having a Ni content of 10 wt % to 30 wt %.

3. The electrical contact material of claim 1, wherein the third contact is attached with a plating material which is a composite material of silver and an oxide, the oxide is one selected from a group consisting of $AgSnInO_x$, $AgSnO_2$, and AgZnO, and a content of the oxide is 5 wt % to 20 wt %.

* * * * *